US005290574A

United States Patent [19]

Jamieson et al.

[11] Patent Number: 5,290,574

[45] Date of Patent: Mar. 1, 1994

[54] CARBONATED BEVERAGE CONTAINER

[75] Inventors: James G. Jamieson, Mauldon; Mark P. Radford, Silsoe, both of England

[73] Assignees: Whitbread PLC, London, England; Heineken Technical Services B.V., Amsterdam, Netherlands

[21] Appl. No.: 859,524

[22] PCT Filed: Dec. 20, 1990

[86] PCT No.: PCT/GB90/01985

§ 371 Date: Jul. 13, 1992

§ 102(e) Date: Jul. 13, 1992

[87] PCT Pub. No.: WO91/09781

PCT Pub. Date: Jul. 11, 1991

[30] Foreign Application Priority Data

Dec. 21, 1989 [GB] United Kingdom ..... 8928893

[51] Int. Cl.[5] ..... B65B 31/00; B65D 17/00; B65D 25/00

[52] U.S. Cl. ..... 426/112; 206/222; 220/270; 220/501; 220/521; 426/115; 426/123; 426/131

[58] Field of Search ..... 426/112, 115, 123, 131; 206/222; 220/270, 501, 521

[56] References Cited

U.S. PATENT DOCUMENTS

| | | | |
|---|---|---|---|
| 3,494,141 | 2/1970 | Irwin et al. | 220/270 X |
| 3,494,142 | 2/1970 | Beck | 220/270 X |
| 3,779,372 | 12/1973 | de Lloret | 206/222 |
| 4,832,968 | 5/1989 | Forage et al. | 426/112 |

FOREIGN PATENT DOCUMENTS

| | | |
|---|---|---|
| 1920694 | 1/1970 | Fed. Rep. of Germany . |
| 2211813 | 7/1989 | United Kingdom . |

*Primary Examiner*—Leo B. Tentoni
*Attorney, Agent, or Firm*—Sughrue, Mion, Zinn, Macpeak & Seas

[57] ABSTRACT

When dispensing carbonated beverages, particularly beer and draught stout, it is desirable to obtain a close-knit creamy head. This contributes to a creamy taste and adds considerably to the customer appeal. To obtain this effect when dispensing from a can (1) it includes a lid (2) having a secondary compartment (4) formed on it and a non-resealable closure (3) in communication with the secondary compartment. At least one orifice (5) extends between the secondary compartment (4) and the inside of the container (1), and a liquid (8) is held in the secondary compartment. The container is arranged so that on opening of the closure (3) the pressure in the secondary compartment (4) is reduced to atmospheric with the result that gas or liquid from the main body of the container (1) is jetted through the at least one orifice (5) into the liquid (8) in the secondary compartment (4) to generate a foam in the secondary compartment. Complete opening or removal of the closure (3) enables the contents of both the secondary compartment (4) and the remainder of the can (1) to be mixed and dispensed together so that the foam produced in the secondary compartment acts to seed the generation of small bubbles throughout the beverage (8) in the can (1).

11 Claims, 5 Drawing Sheets

CARBONATED BEVERAGE CONTAINER

BACKGROUND OF THE INVENTION

When dispensing carbonated beverages, particularly draught stout, it is desirable to obtain a close-knit creamy head. This contributes to a creamy taste and adds considerably to the customer appeal. Traditionally such heads are only obtained when dispensing such beverages from draught. Another factor that considerably enhances the appeal is the way in which, when dispensing from draught, small bubbles are intimately mixed with the body of the beverage as it is dispensed and then, after completion of dispensing they gradually separate out to form this close-knit creamy head.

The formation of such small bubbles liberated throughout the body of the beverage during dispensing can be encouraged by causing shear of the liquid with resulting local pressure changes which causes release of small bubbles of controlled and uniform size. Over the years many proposals have been made to increase and control the generation of such heads on beverages. Our own earlier British Patent specification 1378692 describes the use of an ultrasonic transducer to subject the beer to shear immediately before it is dispensed into a drinking vessel and describes the way that by subjecting the initially dispensed portion of beer to ultrasonics the small bubbles released from this initial portion then gradually float up through the remainder of the beer forming nucleation sites and triggering the generation of further small bubbles of controlled size.

There have been many other proposals such as those described in GB-A-1280240, GB-A-1588624 and GB-A-2211854 to encourage the formation of the required close-knit creamy head on beers and other carbonated beverages. However, most of these proposals are concerned with formation of head as the beer is dispensed from draught.

GB-A-1266351 describes a system for producing a draught type head when dispensing beer, or other carbonated beverage, from a can or bottle. In the arrangement described in this specification, the container includes an inner secondary chamber which is charged with gas under pressure either as part of the filling process in which the container is filled with beverage or by pre-charging the secondary compartment with gas under pressure and sealing it with a soluble plug made from a material such as gelatine which, dissolves shortly after filling. The secondary chamber includes a small orifice and the overall arrangement is such that, upon opening the container and so reducing the pressure in the main body of the container, gas from the secondary chamber is jetted via the orifice into the beer in the main body of the container so causing shear and liberating the required small bubbles which in turn act as nucleation sites to trigger release of similar bubbles throughout the entire contents in the can or other container. The arrangements described in this patent specification are somewhat complex mainly requiring the use of a separate charging step after filling to pressurize the secondary chamber with the result that this technique has not been adopted commercially.

GB-A-2183592 describes a different technique which has recently achieved success in the market place. In this system the container of a beverage includes a separate hollow insert with an orifice in its side wall. As part of the container filling process beer is deliberately introduced into the inside of the hollow insert through the orifice and the pressures of the inside of the insert and the main body of the container are in equilibrium. Upon opening the container the beer is jetted out through the orifice into the body of the beer and again acts to shear liquid in the container with the result that a number of small bubbles are liberated which, in turn, act as nucleation sites to generate a number of small bubbles throughout the entire contents of the container. When dispensing a beverage from such a container into a drinking vessel the liberation of small bubbles throughout the entire volume of the beverage as it is dispensed gives a similar appearance to dispensing the same beverage from draught.

This system has many disadvantages. The use of such an insert occupies a substantial volume of the container and thus requires the use of a special, oversized container. Further, it is essential to remove all of the oxygen from inside the hollow insert before filling the container with beer. The presence of oxygen inside the container leads to the beverage being oxidised with a resulting impairment of flavour and risk of microbial growth leading to, for example, acetification of the resulting beverage when it contains alcohol. Thus, there is a general requirement to displace substantially all of the oxygen from a container, and its secondary chamber, when this is used, before the container is sealed. When the secondary chamber has the form of a hollow insert with only a small orifice in its wall and this insert is filled with air it is difficult to displace all of the air during the filling and sealing of such a container.

As a way of overcoming this problem GB-A-2183592 describes manufacturing such a secondary chamber by a blow moulding technique using an inert gas to form the secondary chamber and then only forming the orifice as the secondary chamber is placed into the container, for example by irradiation with a laser beam. However, in practice, this is not the way that such containers are filled. In practice, the secondary chamber is injection moulded in two halves one of which has a small orifice formed in its wall. The two halves are then welded together enclosing the normal atmospheric gases inside the secondary chamber. Such a secondary chamber is then inserted into an empty container and the whole is subjected to a reduced pressure, filled with a non-oxidising gas such as carbon dioxide, nitrogen, or a mixture of these, and evacuated again to flush substantially all of the oxygen from both the inside of the container and the inside of the secondary chamber before the container is again filled with a non-oxidising gas and then filled with beverage. In this way the amount of oxygen remaining in the sealed container is reduced to an acceptable level but these additional evacuation and flushing steps add a considerable delay and difficulty to the container filling stage with the result that the speed of filling is reduced to about 25 per cent of that in systems in which a secondary chamber is not included in the container. Also, since they require the use of a special, non-conventional filling machine this also imposes a considerable capital cost burden.

SUMMARY OF THE INVENTION

According to this invention a can containing a pressurized carbonated beverage including a lid having a non-resealable closure is characterised by a secondary compartment formed on the lid below the closure, by at least one orifice extending between the secondary compartment and the inside of the can, and by a liquid held in the secondary compartment, the arrangement being such that on opening of the closure the pressure in the secondary compartment is reduced to atmospheric with the result that gas or liquid from the main body of the can is jetted through the at least one orifice into the liquid in the secondary compartment to generate a foam in the secondary compartment: complete opening or removal of the closure enabling the contents of both the secondary compartment and the remainder of the can to be mixed and dispensed together so that the foam produced in the secondary compartment acts to seed the generation of small bubbles throughout the beverage in the can.

Preferably the secondary compartment is partly bounded by the lid of the can. The secondary compartment may include a separate insert, a foil covering sealed to an annular countersunk portion of a conventional can lid or it may have the form of a cup sealed to the underside of the can lid. When it has the form of a separate insert, preferably it is generally laminar and is sandwiched between the rim of the can and the can lid and the secondary compartment is formed between the insert and the lid.

When the closure is of the ring-pull type the initial opening of the ring pull may serve to depressurize the secondary compartment whilst complete removal of the ring-pull serves to provide access to the contents of the main body of the can. Alternatively, when the closure has the form of a stay-on tab, initial actuation of the stay-on tab releases the pressure in the secondary compartment and complete operation of the stay-on tab results in tearing or displacement of the secondary compartment to allow mixing of the contents of the secondary compartment with that of the remainder of the can before or as the contents of the can are dispensed.

Preferably the secondary compartment is filled with beverage derived from the contents of the can and, for example, this may be achieved by inverting the can during an in-can pasteurising step so that, during pasteurisation beverage is driven from the can, through the at least one orifice into the secondary compartment. Alternatively, the beverage may be forced into the secondary compartment through the orifice by dosing the main contents of the can with, for example, liquid nitrogen or solid carbon dioxide pellets before closure of the can so that, as the pressure builds up in the can after seaming on its lid, the liquid contents of the can are forced into the secondary compartment. In this case the can may also be inverted when the orifice in the secondary compartment is not below the level of beverage in the can. The orifice may form part of a liquid trap formed in the secondary compartment to retain liquid in the secondary compartment.

The secondary compartment may contain a head stabilizer to stabilize the foam generated in the secondary compartment upon initial opening of the closure. This head stabilizer by stabilizing the initial foam that is generated ensures that this foam acts as an effective nucleating agent to cause release of small bubbles from throughout the entire contents of the can as the contents of the secondary compartment are dumped into the remainder of the can or as the contents of the secondary compartment is dispensed with those of the remainder of the can into a drinking vessel. When the head stabilizer is a liquid it may be the only liquid present in the secondary compartment. One example of head stabilizer is sugar or a sugar solution which provides a viscous material which produces a long lasting head.

BRIEF DESCRIPTION OF THE DRAWINGS

Typical examples of a can in accordance with this invention will now be described with reference to the accompanying drawings in which.

DETAILED DESCRIPTION OF THE PREFERRED EMBODIMENT

Figure 1:
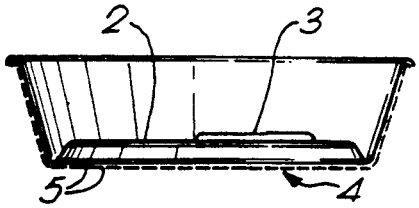
FIG. 1 is a cross-section through a can lid used in the first example.
Figure 2:
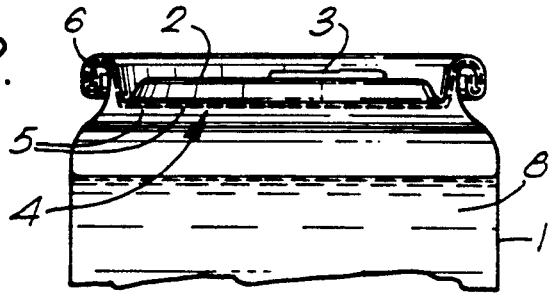
FIG. 2 is cross-section through the top part of a can in accordance with the first example.
Figure 3:
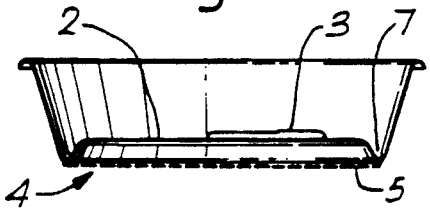
FIG. 3 is a cross-section through a lid used in a second example of this invention.
Figure 4:
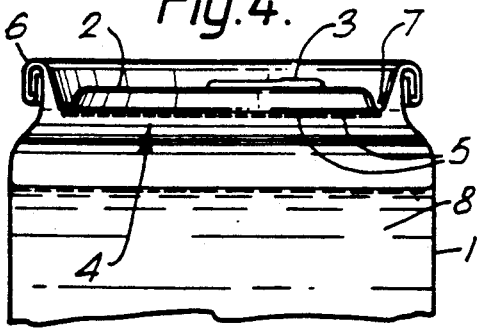
FIG. 4 is a cross-section through the top part of a can in accordance with the second example.

The first example of can in accordance with this invention comprises a can body 1, a lid 2 including an easy open non-resealable closure such as a ring-pull or a stay-on tab 3 and a shell or membrane 4 formed from a plastics or metal foil or laminate. The membrane 4 includes a number of pin holes 5 and its outer periphery is sandwiched between the lid 2 and top rim of the body 1 during formation of the neck seam 6 of the can as shown most clearly in FIG. 2.

The second example of can is generally similar to the first example except that, in this example, instead of being trapped in the seam 6 the membrane 4 is fixed to a countersink portion 7 on the can lid 2. Both the first and second examples operate in a similar fashion and will be described together.

Figure 5:
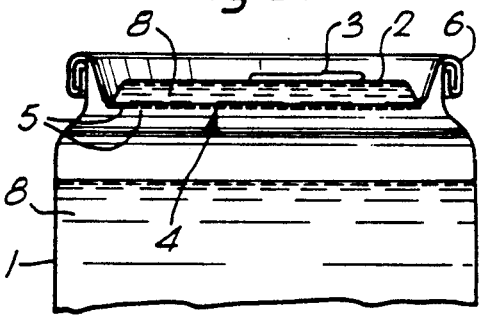
FIG. 5 illustrates the top portion of a can in accordance with a second example after pasteurisation.

The body of the can 1 is filled with beverage 8, in this case a beer, is dosed with solid carbon dioxide or liquid nitrogen to flush the headspace of the can with carbon dioxide or nitrogen and then the lid 2 is placed on top of the can 1 and is seamed into position by forming a double fold of the top rim of a can 1 and the outer periphery of the lid 2 in a conventional can filling machine. The can is then inverted. As the dosing of solid carbon dioxide or liquid nitrogen vapourises the beverage 8 is forced through the pin holes into the secondary chamber formed between the membrane 4 and the liquid 2. Alternatively, the cans are inverted before an in-can pasteurising step and, as a result of the can being heated the pressure in the can increases significantly. Due to the increase in pressure the beverage is forced into the secondary chamber formed between the membrane 4 and the lid 2 via the pin holes 5. When the can is subsequently erected the secondary chamber is substantially filled with beverage 8, as shown in FIG. 5. The pin holes preferably have a size in a range from 0.1 to 2.0 mm and more preferably a size of 0.5 mm so that, whilst the beverage can enter the secondary chamber during in-can pasteurisation, or by being forced in by the increasing pressure inside the body of the can the surface tension of the beverage is sufficient to prevent the beverage being displaced during normal transport and handling.

Figure 6:
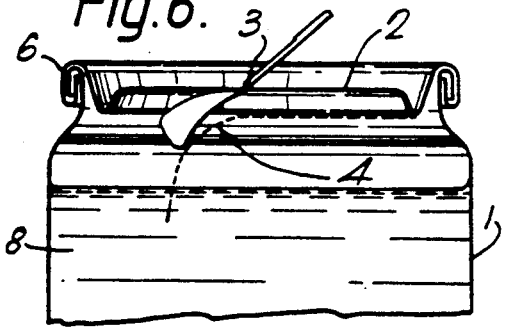
FIG. 6 illustrates the second example of can after opening.
Figure 7:
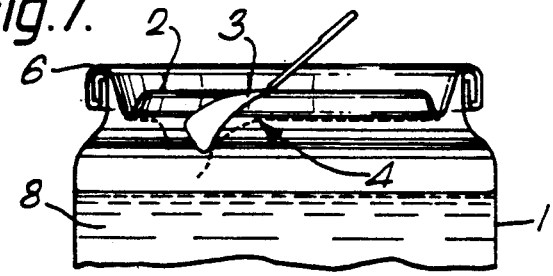
FIG. 7 illustrates a modification of the second example of can after opening.
Figure 8:
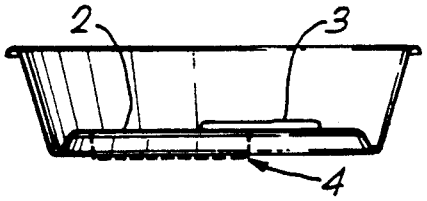
FIG. 8 illustrates a cross-section through the lid of a third example.
Figure 10:
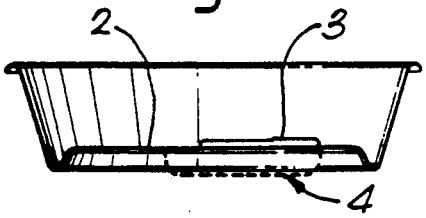
FIG. 10 is a cross-section through the lid used in the modification of the third example.

Upon opening the can 1 the easy opening closure 3 which is in communication with the secondary chamber formed between the lid 2 and the membrane 4 initially vents the secondary chamber so that its internal pressure is reduced to atmospheric pressure. As soon as this happens, gas from the head space of the can is jetted through the pin holes 5 into the beverage 8 in the secondary chamber causing foam to be generated. Further opening of the easy open feature, either complete removal of the ring pull or, as shown in FIGS. 6 and 7 by further lifting of the stay-on tab, opens the secondary compartment either by detaching the separate membrane 4 from around the base of the countersink 7, as shown in FIG. 6, or by tearing the membrane 4 as shown in FIG. 7. This releases the liquid from the secondary chamber into the main body of the can 1 where it joins the remainder of the beverage 8 so that, as the contents of the can are dispensed through the opening formed in the lid 2 the beverage from the secondary chamber mixes with the beverage from the remainder of the can and seeds the formation of a number of small bubbles throughout the entire contents of the can 1.

Figure 9:
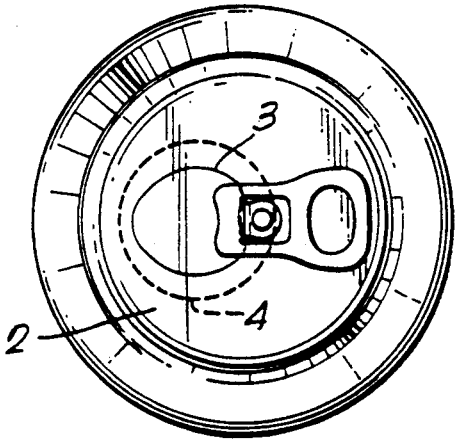
FIG. 9 is a plan of the lid used in the third example.
Figure 11:
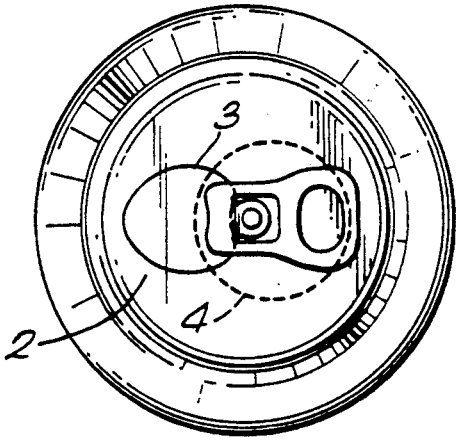
FIG. 11 is a plan of the modification of the third example.
Figure 12:
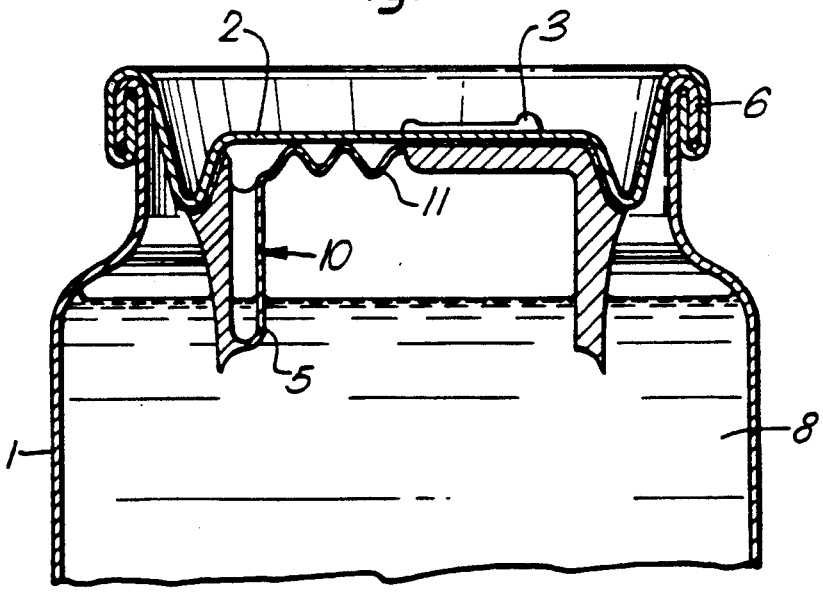
FIG. 12 is a cross-section taken through the top of a can in accordance with the fourth example.

The third example of can in accordance with this invention is somewhat similar to the first two examples but, in this case, the shell or membrane 4 does not extend over substantially the entire under surface of the lid 2. Instead, the shell 4 is formed either only over the entire area of the easy open feature 3 as shown in FIG. 9, or only partly over the area of the easy open feature 3 shown in FIG. 11. In both these examples the easy open feature is shown as a stay-on tab 3 but, particularly FIG. 11, is equally useful with a ring-pull type of tear-off tab. In the modification shown in FIG. 11, the shell does not need to be torn or displaced from the lid 2. Instead, after removal of the tear-off ring pull, as the beverage is poured out of the can 1 since both the contents of the secondary chamber and the contents of the can can be poured through the opening left by the removal of the tear-off tab the contents of the two parts of the can mix as they are dispensed.

Figure 13:
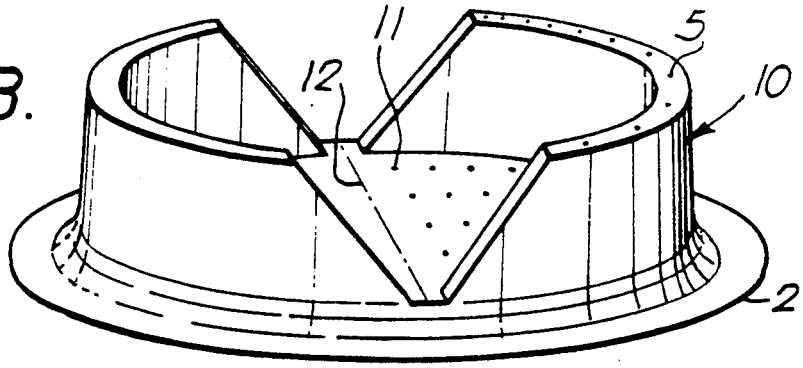
FIG. 13 is a perspective view from the underside of the can lid used in the fourth example.
Figure 14:
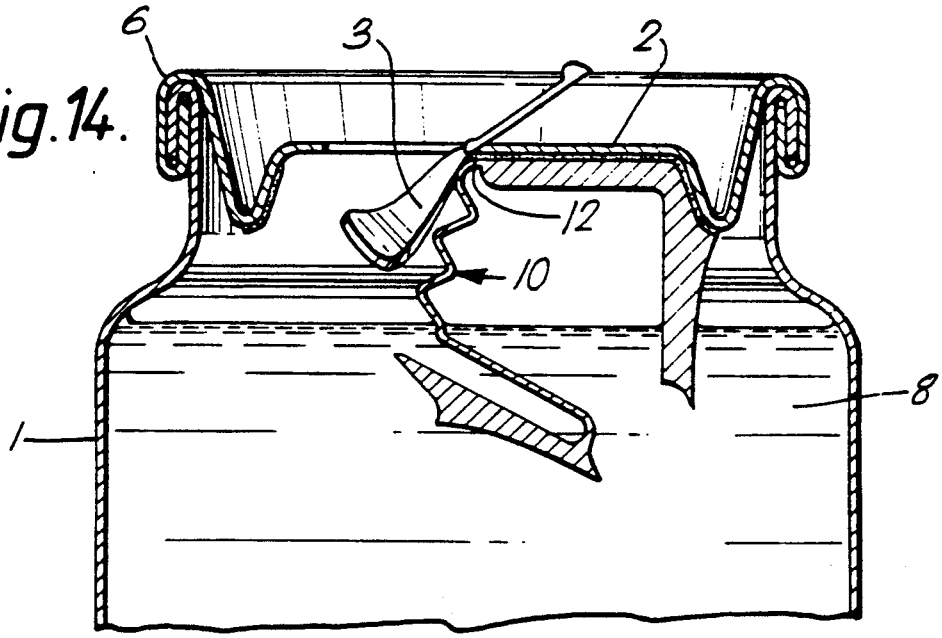
FIG. 14 is a cross-section through the head of a can in accordance with the fourth example after opening.

The fourth example comprises a shell 4 formed as a separate moulded plastics insert 10 shown most clearly in FIG. 13. The insert is heat sealed or glued to the inside of the lid 2 of the can and includes at least one pin hole 5 which, in use, lies below the level of beverage 8 inside the can. Additional pin holes 11 may be provided in a position normally above the beverage level to facilitate venting of some headspace pressure during opening. As shown most clearly in FIG. 13 the insert 10 is formed with a central fold line 12 to facilitate its folding on opening of the can.

With the fourth example, upon dosing of the headspace of the can with liquid nitrogen or solid carbon dioxide, and after the lid 2 is seamed on to the rim of the body 1 the build up of pressure that takes place inside the can forces liquid through the pin holes 5 into the hollow portion of the insert 10 without the need to invert the can. Again, upon initial opening of the easy open feature 3 on the lid 2 of the can it is the secondary chamber formed by the hollow space inside the insert 10 which is initially vented to atmosphere and, as soon as this happens, beverage is jetted through the holes 5 into the beverage inside the secondary chamber. By controlling the relative area of the pin holes 11 and the pin holes 5 the amount of beverage which is jetted into the secondary chamber can be further controlled. Again, upon complete opening of the easy open feature 3 the insert 10 is torn or displaced from the lid 2 of the can 1 to mix the contents of the secondary chamber with those in the main body of the can so that, as the beverage is dispensed from the can small bubbles are liberated from throughout its mass so giving the impression of dispensing a draught beverage. In the drawings one half of the insert is shown as being solid but, depending upon the volume required of the insert this may be hollow and formed like the other half.

Figure 15:
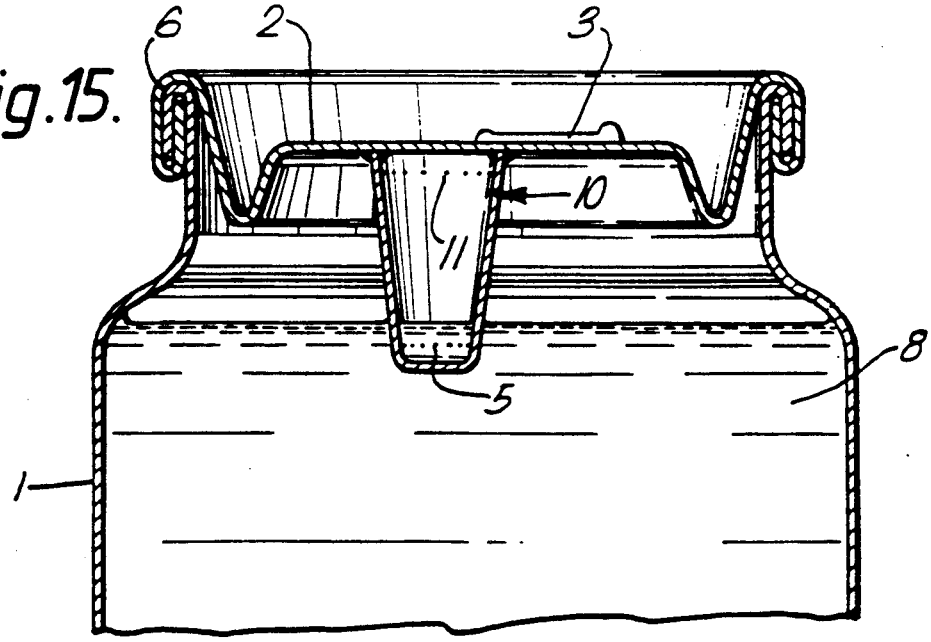
FIG. 15 is a cross-section through the head of a fifth example.
Figure 16:
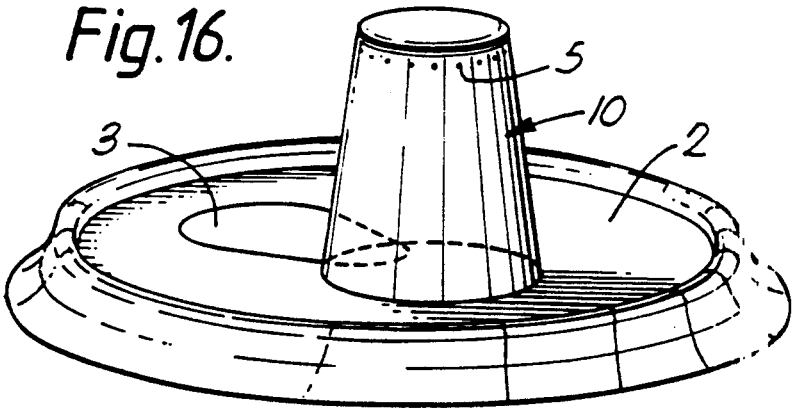
FIG. 16 is a perspective view from the underside of the can used in the fifth example.
Figure 17:
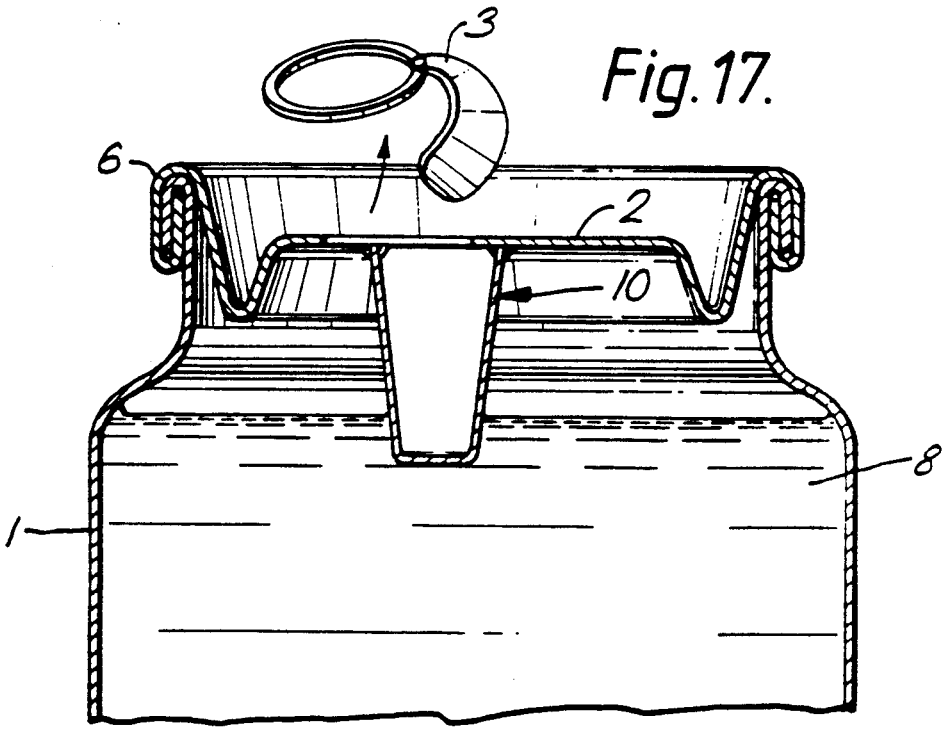
FIG. 17 is a cross-section through the head of the fifth example of the can after opening.

The fifth example shown in FIGS. 15, 16 and 17 is generally similar to the fourth example, only in this case, instead of the shell 10 being generally annular it is cup-like. In the fifth example it is shown with a ring-pull type tear-off tab 3. As with the fourth example, the shell 10 extends down below the level of beverage 8 in the main body of the can and the pin holes 5 are located at a level normally below the level of beverage. Again, additional pin holes 11 may be provided in a location normally above the beverage level. Upon opening the can in accordance with the fifth example, the initial depressurization occurs on the inside of a secondary chamber and again the beverage is jetted through the pin holes 5 into the beverage in the secondary chamber. Complete removal of the ring-pull tab 3 then provides access to both the main body of the can as well as the inside of the secondary chamber so that, upon dispensing the beverage from the can the contents of the secondary chamber are mixed with those of the main body of the can with the result that the contents of the secondary chamber act to seed the beverage from the main body of the can so that small bubbles of foam are liberated throughout the entire contents of the can.

A sixth example is somewhat similar to the fourth example but the shell 10 does not extend so far into the can 1, and so does not extend below the level of the beverage 8 in the can and the holes 5 are inclined so that their inner ends are lower than their upper ends. In this way the holes 5 form liquid traps which prevent all the liquid 8 inside the shell 10 being displaced and ensure that, upon opening, when gas is jetted through the holes 5 it is always jetted into liquid 8 in the shell 10.

Figure 18:
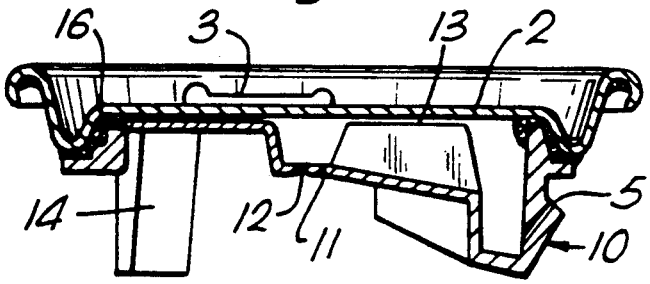
FIG. 18 is a cross-section through the lid of a sixth example before fitting.
Figure 19:
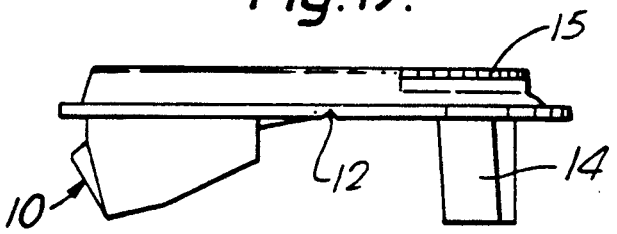
FIG. 19 is a side elevation of the shell of the sixth example.
Figure 20:
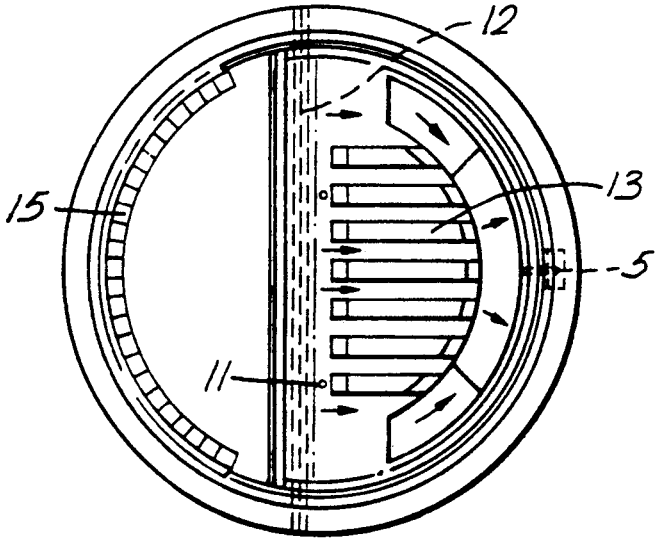
FIG. 20 is a plan of the shell of the sixth example.
Figure 21:
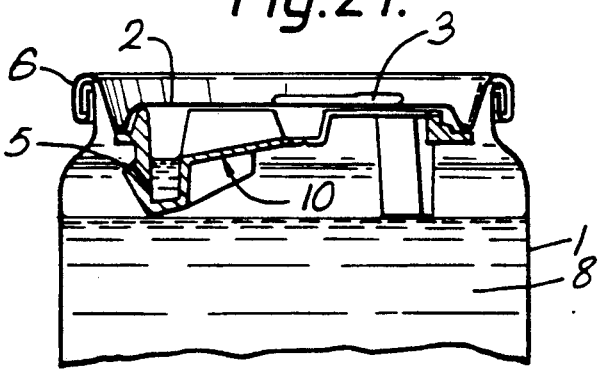
FIG. 21 is a cross-section through the sixth example after filling.

The shell 10 is injection moulded from polypropylene and comprises two parts separated by the chordal fold line 12. The opening portion contains the inclined hole, or holes 5 and forms a liquid receiving chamber. The base wall of this part slopes in the direction of the arrows shown in FIG. 20 so that the deepest portion is adjacent the lower most end of the inclined hole 5. Ribs 13 shown most clearly in FIG. 18 and 20 rest against the lid 2 of the can. The fixed portion of the insert includes two or more legs 14 of a similar depth to that of the opening portion defining the liquid receiving chamber so that the lids are stable when stacked. The shell 10 is fixed to the lid 2 by an annular layer of adhesive 16, typically of the reactive hot melt type. Polypropylene has poor adhesion properties and even with this adhesive it is difficult to obtain a reliable bond between the polypropylene insert 10 and the adhesive. To overcome this difficulty the circumferential part of the fixed portion includes a number of holes or dove-tailed portions 15 which provide a mechanical key with the adhesive to ensure that this fixed portion is retained by the adhesive firmly stuck to the lid 2 of the can 1. In contrast to this the rim of the opening portion is generally smooth and thus, whilst a sufficiently secure attachment is made between the shell 10 and the adhesive it is this join which parts easily upon opening the stay-on tab 3 to apply downward pressure via the ribs 13 to the opening portion of the shell 10. Even if this part is not securely joined the act of opening the stay-on tab and the consequent reduction in pressure inside the insert 10 urges the opening portion against the lid to form a seal until the pressure in the can has reduced to atmospheric where on further opening of the stay-on tab 3 positively moves the insert 10 away from the lid 2.

The gas vent hole 11 above the liquid level in the shell 10 in this and the earlier examples provides equalization of the pressure between the inside of the shell 10 and the inside of the can 1. Thus, whilst the can is in storage and subjected to temperature changes, pressure fluctuations between the inside of the shell 10 and the inside of the can 1 are avoided and thus there is no tendency to expel the liquid from the inside of the shell 10 via the inclined hole 5. Upon opening of the container the gas vent hole 11 also allows some of the gas in the head space of the can 1 to be vented directly to atmosphere via the gas vent 11 so that not too much fob is generated via gas injection through the inclined hole 5. Naturally the ratio of sizes or numbers of vents 5 and 11 are arranged to provide generation of the required amount of foam in the shell 10 as the stay-on tab 3 is opened. To ensure that the beverage 8 is introduced into the inside of the shell 10, in spite of the shell 10 not extending below the level of the beverage 8, the can 1 is preferably inverted immediately after filling and during evaporation of a dose of liquid nitrogen which is inserted with the liquid into the can or is held inverted during an in-can pasteurisation process as described previously.

All of the examples in accordance with this invention have a considerable advantage over those disclosed in GB-A-1266351 and GB-A-2183592. The arrangements shown in all of the examples can be fitted to standard size cans, using conventional, standard can filling machinery at substantially the same speed as that at which cans are conventionally filled. By providing the secondary chamber in association with the lid, the secondary chamber can, if required, be pre-assembled with the lid and then the lid be fitted on in a conventional can filling machine If required the inside of the secondary chamber associated with the lid may be prefilled with beverage, or be filled with a head stabilizing liquid such as sugar solution so that, when the gas or liquid is jetted into the secondary chamber, instead of being jetted into the same beverage as carried by the remainder of the can it may be jetted into the head stabilizing liquid direct so that, upon subsequent mixing of the contents of the secondary chamber with the remaining contents of the can the seed bubbles resulting from the secondary chamber have a longer life.

We claim:

1. A can (1) containing a pressurized carbonated beverage (8) including a lid (2) having a non-resealable closure (3); the can being characterised by a secondary compartment (4) formed on the lid (2) below the closure (3), by at least one orifice (5) extending between the secondary compartment (4) and the inside of the can (1), and by a liquid (8) held in the secondary compartment (4), the arrangement being such that on opening of the closure (3) the pressure in the secondary compartment (4) is reduced to atmospheric with the result that gas or liquid from the main body of the can (1) is jetted through the at least one orifice (5) into the liquid (8) in the secondary compartment (4) to generate a foam in the secondary compartment (4): complete opening or removal of the closure (3) enabling the contents of both the secondary compartment (4) and the remainder of the can (1) to be mixed and dispensed together so that the foam produced in the secondary compartment acts to seed the generation of small bubbles throughout the beverage (8) in the can (1).

2. A can according to claim 1, in which the secondary compartment is partly bounded by the lid (3) of the can (1).

3. A can according to claim 1 or 2, in which the closure (3) is of the ring-pull type and, the initial opening of the ring pull depressurizes the secondary compartment (4) whilst complete removal of the ring-pull provides access to the contents of the main body of the can (1).

4. A can according to claim 1 or 2, in which the closure (3) has the form of a stay-on tab and, initial actuation of the stay-on tab releases the pressure in the secondary compartment (4) and complete operation of the stay-on tab results in tearing or displacement of the secondary compartment (4) to allow the contents of the secondary compartment to join those of the remainder of the can (1) before or as the contents of the can (1) are dispensed.

5. A can according to claim 1 or 2, in which the secondary compartment (4) is filled with beverage (8) derived from the contents o can (1).

6. A can according to claim 1 or 2, in which the secondary compartment (4) extends across the width of the lid (3) and includes a depending portion (10) of partly annular form which holds the liquid (8), and in which the at least one orifice (5) opens into the depending portion (10).

7. A can according to claim 6, in which the secondary compartment (4) is fixed to the lid (3) by heat sealing or an adhesive.

8. A can according to claim 1 or 2, in which the secondary compartment (4) is formed with a chordal fold line (12) to enable it to fold on opening the closure (3) to discharge its liquid contents and enable the liquid inside the can to be dispensed.

9. A can according to claim 8, which includes mechanical keys (15) on the secondary compartment (4) to one side of the chordal fold (12) to ensure that that side of the chordal fold (12) remains fixed to the lid (3) upon opening the closure (3).

10. A can according to claim 6, in which the secondary compartment (4) also includes legs (14) which depend from the opposite side of the secondary compartment to the depending portion (10) so that the lids are stackable before being seamed onto the remainder of the can (1).

11. A can according to claim 1 or 2, in which at least two orifices (5,11) are included, one (5) opening below the level of liquid (8) in the secondary compartment (4) and the other (11) above.

* * * * *